United States Patent [19]

Ibrahim

[11] 4,408,465

[45] * Oct. 11, 1983

[54] MULTIBAND REFRIGERATED DISPLAY CASE HAVING A TOP ACCESS OPENING

[75] Inventor: Fayez F. Ibrahim, Niles, Mich.

[73] Assignee: Tyler Refrigeration Corporation, Niles, Mich.

[ * ] Notice: The portion of the term of this patent subsequent to Jul. 27, 1999 has been disclaimed.

[21] Appl. No.: 295,542

[22] Filed: Aug. 24, 1981

Related U.S. Application Data

[63] Continuation-in-part of Ser. No. 11,804, Feb. 14, 1979, abandoned.

[51] Int. Cl.[3] ..... F25D 21/12

[52] U.S. Cl. ..... 62/82; 62/256; 62/255; 62/151

[58] Field of Search ..... 62/155, 256, 255, 276, 62/82, 151

[56] References Cited

U.S. PATENT DOCUMENTS 4,148,197 4/1979 Karashima ..... 62/256

4,341,081 7/1982 Ibrahim ..... 62/256

*Primary Examiner*—Albert J. Makay

*Assistant Examiner*—Henry Bennett

*Attorney, Agent, or Firm*—LeBlanc, Nolan, Shur & Nies

[57] ABSTRACT

An open top refrigerated display case having mechanisms for establishing an inner refrigerated air band encircling the display portion of the case and an outer air band also encircling the display portion and being positioned outside of the inner air band. An inner air conduit passes around the side and bottom walls of the cabinet of the display case and has an outlet opening at one end of the opening in the top of the cabinet and an inlet opening at the other end of the top opening in the cabinet. A fan circulates air through this inner air conduit with the air leaving the outlet opening and being directed toward and received by the inlet opening of the conduit, thereby establishing an inner air band along with an inner air curtain across the opening in the top of the cabinet. An evaporator coil arranged within the inner air conduit serves to refrigerate the air passing along the inner air band during a refrigeration cycle of operation. An outer air conduit surrounds the inner air conduit within the cabinet and during a refrigeration cycle carries air which is cooler than ambient air, but unrefrigerated. A second fan is provided within this outer air conduit for circulating air through the conduit and establishing an outer air band and outer air curtain across the opening in the top of the cabinet. During a defrost cycle of operation, the evaporator coil is turned off and the direction of air flow through at least one of the inner or outer air conduits is reversed and unrefrigerated air is caused to pass through the inner air conduit, thereby serving to defrost that conduit.

21 Claims, 8 Drawing Figures

MULTIBAND REFRIGERATED DISPLAY CASE HAVING A TOP ACCESS OPENING

RELATED PATENT AND APPLICATION

This application is a continuation-in-part of U.S. patent application Ser. No. 11,804 entitled OPEN TOP MULTIBAND REFRIGERATED DISPLAY CASE and filed Feb. 14, 1979, now abandoned, which is incorporated herein by reference. The present application is related to U.S. Pat. No. 4,106,305 to the same inventor and assigned to the same assignee as the present application and the subject matter of that patent is incorporated herein by reference.

BACKGROUND OF THE INVENTION

The present invention relates to open top refrigerated display cases having an ambient air defrost system. Both within the specification and the claims of the present application, all references to refrigeration apparatus or refrigeration operations are intended to include cooling both at a temperature below 32° F., such as associated with frozen food display cases, and in excess of 32° F., such as typically associated with dairy food and fresh meat display cases.

In the operation of all types of refrigerated display cases, it is desirable to include a system capable of automatically defrosting the display case. The defrost cycle can be actuated either at set periodic times or when the frost buildup within the system has reached a certain predetermined level. Such systems are typically thermostatically controlled so as to switch from a refrigeration cycle to a defrost cycle of operation. By this manner of operation, it is possible to avoid any significant frost buildup within the display case.

Typically within the prior art, there have been three different approaches employed for defrosting refrigerated display cases. The first approach involves the use of electric resistance heaters that are arranged adjacent to the refrigeration coils of the refrigeration mechanism. During a defrost cycle, these heaters supply heat in an effort to eliminate the frost buildup on the coils but also adds warmer air to the air conduit for circulation within the case. The particular technique is relatively simple both in its construction and operation. The electrical heaters are high wattage heaters however and thus utilize significant electricity during operation. Furthermore, the warm air circulated in the case can raise the temperature of the case too high. Thus, attempts have been made to find other alternatives to such system.

A second type of system circulates hot gaseous refrigerant through the refrigeration coils during the defrost cycle. During the defrost cycle, a valve control mechanism shuts off the supply of refrigerant to the refrigeration coils and alternatively feeds hot gaseous refrigerant through the coils. While this gas serves to get rid of any frost buildup that has occurred on the refrigeration coils, it simultaneously provides heat within the air conduit which can be circulated through the display case, which again is disadvantageous. Due to the requirement that the system be able to selectively switch between the supply of gas and refrigerant to the refrigeration coils, a complicated valving structure must be provided.

The third type of system employed for defrosting display cases relies upon ambient air. It is this general category with which the invention of the present application is concerned. One type of system that employes ambient air during the defrost cycle is exemplified by those embodiments illustrated in U.S. Pat. Nos. 3,403,525, 3,850,003 and 3,937,033, all to Beckwith et al. Each of these systems use fans separate from the main air circulating fans. These extra fans are turned on during the defrost cycle for pulling ambient air from outside of the display case into the air conduits. A second type of system is illustrated in U.S. Pat. No. 3,082,612 to Beckwith, which system draws ambient air into the main circulation path through ports located in the lower front panel of the refrigerated display case. Such ports are normally closed during the refrigeration cycle and are opened during the defrosting cycle. The Beckwith et al. U.S. Pat. No. 3,850,003 indicates that the concepts described in U.S. Pat. Nos. 3,082,612 and 3,403,525 did not prove to be practical and hence were not commercially feasible.

Finally, a third type of ambient air defrosting system is shown in U.S. Pat. No. 4,144,720 to Subera et al., which is assigned to the same assignee as the present application. In the foregoing patent application, an open front refrigerated display case having primary and secondary air conduits is disclosed. In this system, reversible fans are employed for reversing the direction of flow of air within the conduits and simultaneously drawing in air from outside of the display case.

Other systems employing reversible fans for ambient air defrost are shown in U.S. Pat. No. 4,026,121 to Aokage and U.S. Pat. No. 4,120,174 to Johnston. The Aokage patent, however, refers to an open front display case in which the air flow between the primary and secondary air bands is short-circuited for the purpose of supplying warmer air to the primary band. The Johnston patent illustrates an open top display case having only a single air band.

None of the above-noted patents show an open top refrigerated display case having an inner band of refrigerated air and an outer band of cool but unrefrigerated air. Furthermore, such prior art does not show an ambient air defrost system employed within such an open top multiband refrigerated display case.

SUMMARY OF THE INVENTION

An object of the present invention is to provide a multiband open top refrigerated display case having an ambient air defrost system.

Another object of the present invention is to provide an open top refrigerated display case having substantial operational advantages as compared to previously known systems.

A further object of the present invention is to provide an open top refrigerated display case having an ambient air defrost system having an improved efficiency of operation as compared to previously known systems.

A still further object of the present invention is to provide a multiband open top refrigerated display case, wherein during a defrost cycle of operation ambient air is circulated through the inner air conduit in which the refrigeration mechanism is located.

A still further object of the present invention is to provide a multiband open top refrigerated display case in which during a defrost cycle of operation the flow of air through the outer air conduit is reversed and such air is directed into and circulated through the inner air conduit.

Still another object of the present invention is to provide a multiband open top refrigerated display case in which during a defrost cycle of operation the flow of air through both the inner and outer air conduits is reversed and ambient air is drawn into such conduits.

These objectives are achieved by the provision of a multiband open top refrigerated display case in accordance with the present invention. As the term is used throughout this application, both in the specification and in the claims, all references to an open top display case is intended to include both top display cases and well-type display cases. In all of the embodiments of the open top display cases in accordance with the present invention, the cases have inner and outer U-shaped air conduits that extend along opposing side walls and the bottom wall of the cabinet of the display case. The opposing side walls to which reference is made are typically the front and back walls of the display case. Both the inner and outer air conduits have air outlet and air inlet openings, which are disposed at the upper ends of the conduits at opposing sides of the opening in the top wall of the display case. The air outlets and inlets are arranged so that air leaving the outlet from each of the conduits will be directed towards and received by the corresponding inlet of the same conduit. Thus, by circulating air through the conduits an air curtain is established across the opening in the top of the display case as an air band is established. During a refrigeration cycle of operation of the display case, the air circulated through the inner air conduit is refrigerated by an evaporator coil or a set of evaporator coils arranged within such conduit. While the air circulated through the outer air conduit during a refrigeration cycle of operation is not refrigerated, such air is typically cooler than ambient air. Inasmuch as the inner and outer air conduits share at least a partial common wall, if not a common wall along their entire length, the conduits are in a heat exchanging relationship and the air passing through the outer air conduit will be cooled by conduction of the colder temperatures through the common wall.

In such multiband open top display cases, the inner air band of refrigerated air that is established serves to refrigerate the products displayed within the case. The outer band of unrefrigerated but cool air serves as a barrier for protecting the inner refrigerated air band. Thus, the outer air curtain formed by the outer air band prevents ambient air from outside of the display case from entering and mixing with the inner air curtain of refrigerated air in the area of the opening in the top of the display case.

During the defrost cycle of operation of such a multiband open top refrigerated display case, ambient air is circulated through the inner air conduit which serves to defrost the evaporator coil or coils within such conduit, along with eliminating frost buildup on any other elements within that conduit. During the defrost cycle as the ambient air is circulated through the inner air conduit, the refrigeration mechanism is deactivated. In order to cause the ambient air to be circulated through the inner air conduit, the flow direction of air through either the inner or outer air conduit or both conduits is reversed and ambient air is drawn into at least one of the conduits. If the ambient air is drawn into the outer air conduit, then such air is circulated through the outer conduit and is diverted into the inner conduit so as to mix with the inner air band. In this manner, the temperature of the air flowing through the inner air conduit is increased, so as to carry out the defrosting operation.

In several of the embodiments of the present invention, the direction of air flow through the inner air conduit is maintained while the air flow through the outer air conduit is reversed. At the time that the air flow through the outer air conduit is reversed, air is diverted from the outer air conduit into the flow path of the air through the inner air conduit. This diversion of the air through the outer air conduit disrupts the outer air band. In addition, any air leaving the outer air conduit during such a reverse flow, which air would be expelled through the air inlet of the outer air conduit is directed up and away from the display case. Consequently, ambient air from outside of the display case is drawn into the outlet opening of the outer air conduit and such ambient air is then diverted into the flow of air through the inner air conduit, thereby serving to defrost the elements within the inner air conduit.

In an alternative type of embodiment of the present invention, the air flow through both the inner and outer air conduits is reversed during a defrost cycle of operation. During such a reverse flow, the air is expelled from both conduits through the inlet openings and such air is directed up and away from the display case. Since the fans are still drawing air into the conduits, a partial vacuum is created in the area of the outlet openings in such conduits, thereby causing ambient air from outside of the display case to be drawn into such conduits. Such ambient air is then circulated through the conduit for defrosting the elements within such conduits, in particular, for defrosting the evaporator coils in the inner air conduit.

In another type of embodiment of the present invention, the direction of air flow through the outer air conduit is maintained during the refrigeration and defrost cycles of operation. The direction of air flow through the inner air conduit, however, is reversed during the defrost cycle of operation. While a portion of the air leaving the inlet of the inner air conduit during such a reverse flow will be directed up and away from the display case, due to the construction of the inlet opening, the outer air band will cause a portion of such inner air band to be directed across the opening in the top of the display case. During such a reverse flow of the inner air band, however, the inner and outer air curtains will be flowing in opposing directions. Thus, as the air of the inner air band flows across the inner air curtain air from the outer air curtain will be mixed with the air of the inner air band, thereby increasing the temperature of the inner air band. Since the evaporator coils within the inner air conduit have been turned off during the defrost cycle of operation, the air passing through the inner air conduit is warmed up to a sufficient extent for carrying out a defrosting operation.

DESCRIPTION OF THE PREFERRED EMBODIMENTS

Figure 1:
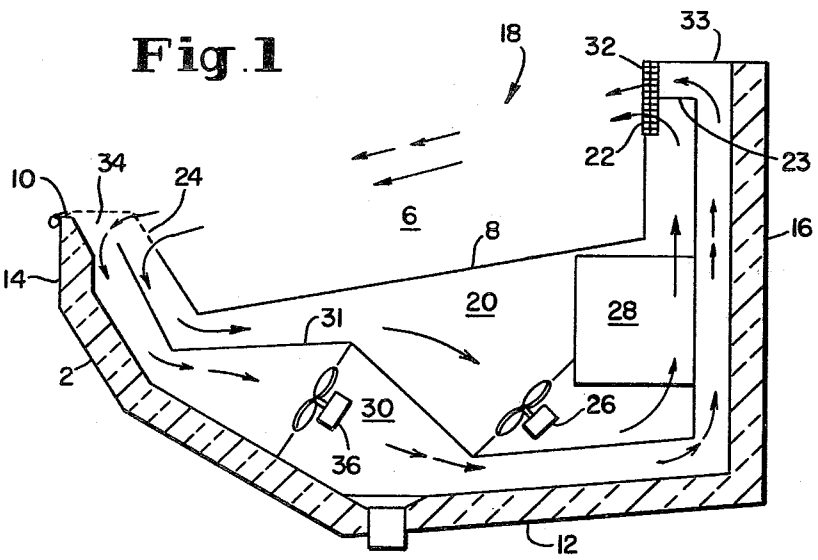
FIG. 1 is a side elevational, sectional view of a top display case in accordance with the present invention during a refrigeration cycle of operation.
Figure 2:
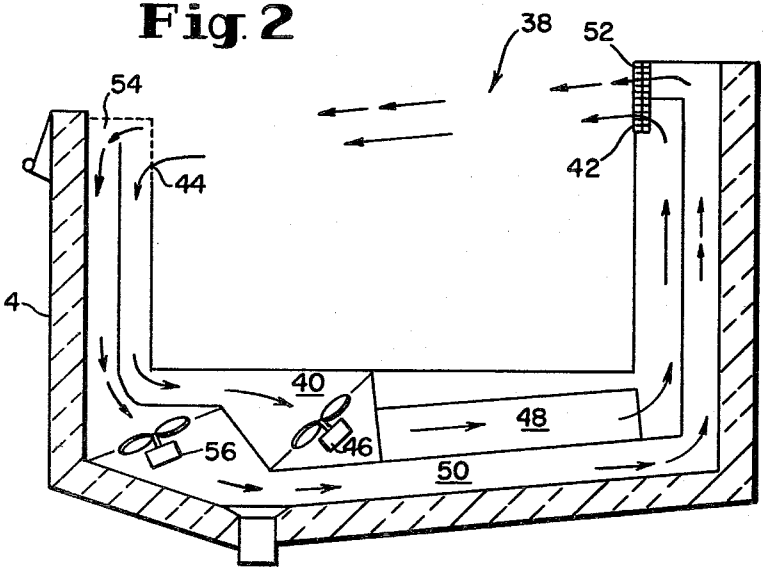
FIG. 2 is a side elevational, sectional view of a well-type display case in accordance with the present invention during a refrigeration cycle of operation.

Throughout the specification and claims herein, the terminology open top refrigerated display case is intended to include both an open top display case 2 and a well-type case 4, as illustrated in FIGS. 1 and 2, respectively. Open top display case 2 has a display portion 6 with a display shelf 8 on which the refrigerated products to be displayed are placed. Display case 2 has a top wall 10, a bottom wall 12 and opposing side walls 14 and 16; the other two side walls at the longitudinal ends of the display case have not been illustrated for sake of clarity. An opening 18 in top wall 10 enables access to the refrigerated products placed on shelf 8.

An inner air conduit extends around opposing side walls 14 and 16 and bottom wall 12 so as to be approximately U-shaped in formation. At one upper end of conduit 20 is an outlet opening 22 and at the opposite end of the conduit is an inlet opening 24. Openings 22 and 24 are at opposite ends of opening 18 in the top of the display case. Above outlet opening 22 is a top wall member 23 of the conduit which helps to direct air leaving conduit 20 in a direction across opening 18 and towards inlet opening 24 of conduit 20. Air is circulated through inner air conduit 20 by at least one fan 26, although a plurality of fans can be utilized with the number of fans being dependent upon the size of the case and the size of the fans. An evaporator coil or a plurality of such coils are arranged within inner air conduit 20 as designated by box 28. The evaporator coils serve to regrigerate the air circulated through inner air conduit 20 during a refrigeration cycle.

An outer air conduit 30 surrounds inner air conduit 20. The two air conduits share a common wall 31. While the air passing through outer air conduit 30 is not refrigerated, the air is cold by conduction of the colder temperatures through common wall 31 from inner air conduit 20 to outer air conduit 30. Outer air conduit 30 has an outlet opening 32 at one end and an inlet opening 34 at its other end. Openings 32 and 34 are positioned at opposite sides of opening 18 in the top of display case 2. Above outlet opening 32 is a top wall 33 of conduit 30. Top wall member 33 helps to direct the air leaving outlet opening 32 across opening 18 and towards inlet opening 34. At least one fan 36 is mounted within outer air conduit 30 for circulating the air through the conduit. Although only one fan is illustrated, a plurality of fans can be used with the number of fans depending on the size of the display case and the size of the fans.

During a refrigeration cycle of operation, air is circulated through conduit 20 by fan 26 in the direction shown by the arrows in FIG. 1. Evaporator coils 28 are activated and as the air passes over the evaporator coils, the air is refrigerated. The air is then expelled out of outlet opening 22 and is directed across opening 18 in the top of display case 2. The air travels across opening 18 and is then received back into the conduit through inlet opening 24. In this manner, a continuous band of refrigerated air is established within display case 2 with an air curtain of refrigerated air being present across opening 18 in the display case. During the refrigeration cycle, air is also circulated through outer air conduit 30 by fan 36 in the direction of the arrows illustrated in FIG. 1. This air passing through the outer air conduit is expelled from outlet opening 32 where it is directed across opening 18 in the display case and received by inlet opening 34 so as to re-enter outer air conduit 30. In this manner a continuous band of cool but unrefrigerated air is established which surrounds the inner refrigerated air band, with an outer air curtain being established across opening 18 in the display case. This outer air curtain serves as a barrier protecting the refrigerated air curtain and the refrigerated products from the ambient air outside of the display case, thereby preventing any rise in the temperature of the refrigerated air due to mixing with ambient air.

The construction and operation of well-type display case 4 is substantially similar to open top case 2 as explained above. The well-type case is illustrated in FIG. 2. Display case 4 has top, bottom and side walls with an opening 38 in its top wall for enabling access to products within the display case. An inner air conduit 40, which is approximately U-shaped, extends around the side and bottom walls of the display case. Inner air conduit 40 has an outlet air opening 42 at one end and an inlet air opening 44 at its opposite end. Openings 42 and 44 are arranged at opposite sides of opening 38 in the display case. The openings 42 and 44 are constructed and aligned so that air expelled through outlet opening 42 is directed across opening 38 in the display case and received by inlet opening 44 so as to re-enter the conduit. Surrounding inner air conduit 40 is an outer air conduit 50, which is also approximately U-shaped in formation. Outer air conduit 50 has an outlet opening 52 at one end and an inlet opening 54 at its opposite end, with such openings being arranged at opposite sides of opening 38 in the top of the display case. Again, openings 52 and 54 are constructed and aligned so that air expelled through outlet opening 52 is directed across opening 38 towards inlet opening 54 so that such air re-enters the conduit.

At least one fan 46 is positioned within inner air conduit 40. The number of fans can vary depending on the size of the display case and the size of the fans. Also positioned within inner air conduit 40 is an evaporator coil or a plurality of evaporator coils, such as represented by box 48. The evaporator coils serve to refrigerate the air circulated through conduit 40 during a refrigeration cycle. Arranged within conduit 50 is a fan 56 or a plurality of fans depending on the size of the display case and the size of the fans.

During the refrigeration cycle in operating display case 4, a continuous air band is established through the inner air curtain 40, such as shown by the arrows in FIG. 2 with an air curtain of refrigerated air being established across opening 38 in the top of the display case. An outer air band of cool but unrefrigerated air surrounds the inner air band such as shown by the arrows in FIG. 2 again with an appropriate curtain of cool air extending across opening 38 in the display case.

The defrost operation of both the various open top display cases 2 and the various well-type display cases 4 is essentially the same. Hence the discussion below only specifically addresses the open top cases.

Figure 3:
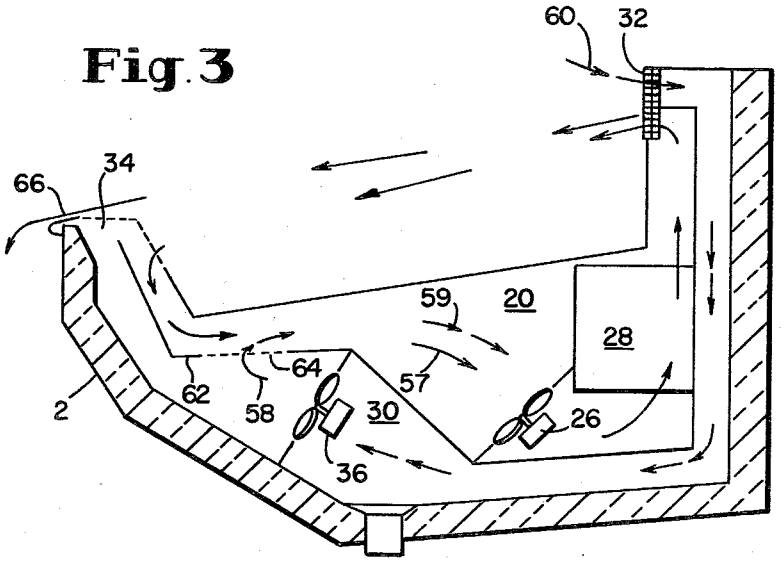
FIG. 3 is a side elevational, sectional view of another embodiment of a top display case in accordance with the present invention during a defrost cycle of operation.

During a defrost cycle of operation, the direction of air flow through at least one of the two air conduits is reversed and air warmer than the refrigerated air, normally ambient air, is caused to flow through the inner air conduit. Thus, in a modified embodiment of the present invention such as shown in FIG. 3, display case 2 is being operated in a defrost cycle of operation. While the direction of air flow through inner air conduit 20 is maintained, the air flow direction through outer air conduit 30 has been reversed. In addition, evaporator coils 28 are deactivated so that air passing through conduit 20 is not refrigerated. A portion 62 of common wall 31 has a plurality of perforations 64. As the air is circulated in a reverse direction through conduit 30, such air flows from outer air conduit 30 into inner air conduit 20, as represented by arrow 58. This air flows into inner air conduit 20 from outer air conduit 30 then blends with the air flowing through the inner air conduit and since the air from the outer air conduit is of a higher temperature, the air flowing into the inner air conduit serves to increase the temperature of the inner air band. Since the majority of the air flowing through the outer air conduit is diverted into the inner air conduit, little or no air is expelled from the conduit. Any air that is expelled, however, leaves the conduit through inlet opening 34, with such air being directed upwardly and away from the display case due to the construction of such inlet opening. Thus, there is no outer air band and hence no outer air curtain across the opening in the display case, or at the very least only a very small outer air curtain extending across such opening. Thus a partial vacuum is created within outer air conduit 30 in the area of outlet opening 32. This vacuum causes ambient air from outside the display case to be drawn into outer air conduit 30, such as by shown by arrow 60. Such ambient air then is circulated through outer air conduit 30 and into inner air conduit 20, thereby further increasing the temperature of air flowing through the inner air conduit. Such higher temperature air serves to defrost the evaporator coils and other parts within the inner air conduit. With the absence of the outer air curtain, the inner air curtain is no longer pressed downwardly and hence a portion of the air flowing along such curtain can flow over the top of the display case such as shown by arrow 66.

Figure 4:
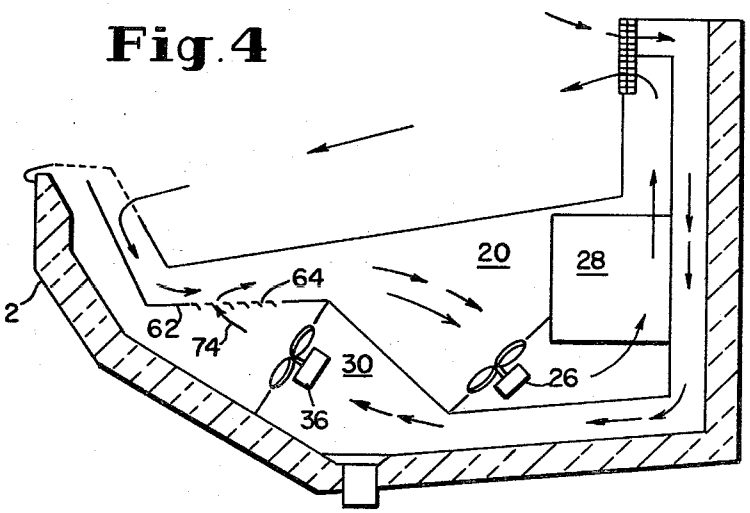
FIG. 4 is a side elevational, sectional view of a top display case in accordance with another embodiment of the present invention during a defrost cycle of operation.

In a modified embodiment of that embodiment illustrated in FIG. 3, a guide fin 74 can be located adjacent to each of the perforations 64 in wall portion 62, such as illustrated in FIG. 4. Guide fins 74 help to direct air from the reverse air flow through conduit 30 into conduit 20.

Figure 5:
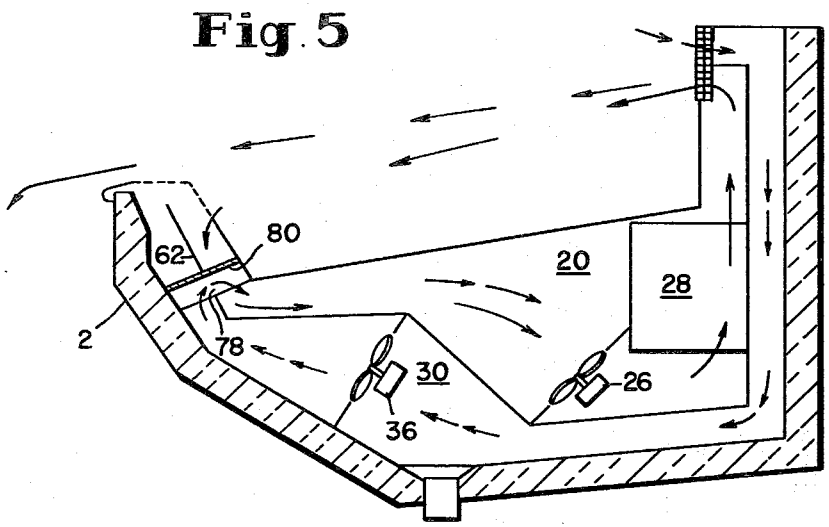
FIG. 5 is a side elevational, sectional view of a top display case in accordance with another embodiment of the present invention during a defrost cycle of operation.
Figure 6:
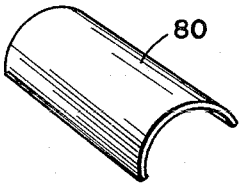
FIG. 6 is a perspective view of an air scoop to be utilized in the display cases illustrated in FIG. 5.

Instead of using a plurality of perforations and guide fins, it is possible to provide a single opening 78 in wall portion 62 and to mount an air scoop 80 within such opening, such as illustrated in FIG. 5. An exemplary embodiment of such an air scoop 80 is illustrated in FIG. 6. A plurality of small air scoops can be provided along the longitudinal path of the opening in wall portion 62 or alternatively, several large air scoops can be used which extend along a substantial portion of the length of such wall portion 62. As the air flowing through conduit 30 in a reverse direction strikes air scoop 80, such air is directed into the inner air conduit, such as shown by the arrow.

Figure 7:
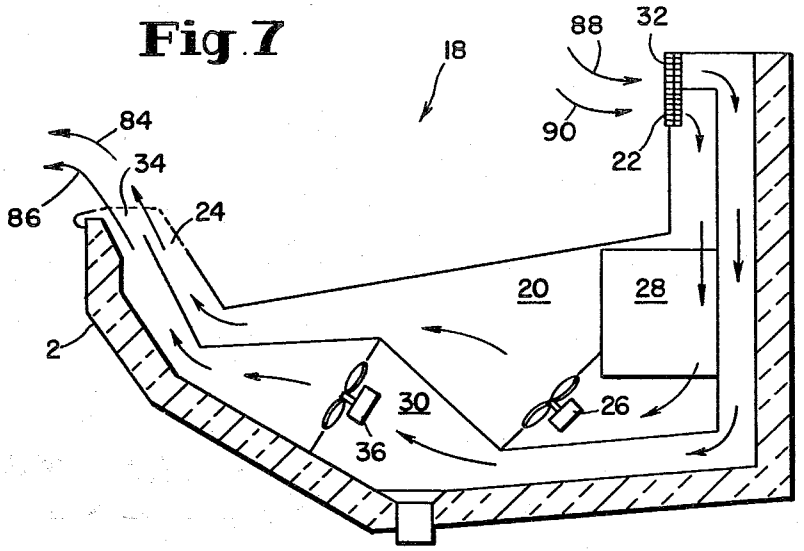
FIG. 7 is a view of a top display case such as that illustrated in FIG. 1 during a defrost cycle of operation.

In another embodiment of the display cases, the direction of air flow through both of the conduits can be reversed. Thus, as shown in FIG. 7, the direction of air flow through both inner air conduit 20 and outer air conduit 30 is reversed, thereby at least substantially if not totally eliminating the continuous air band and the air curtains across the top of the display case. The air flowing through conduits 20 and 30 in the reversed direction is expelled through inlet openings 24 and 34, respectively. Such air is expelled in a direction upwardly and away from the display case, such as represented by arrows 84 and 86, respectively. Since the continuous air bands and air curtains have been eliminated, partial vacuums are created within the air conduits in the area of outlet openings 22 and 32. These partial vacuums serve to draw in ambient air from outside of the display case, such as represented by arrows 88 and 90. The flow of ambient air through inner air conduit 20 serves to defrost evaporator coils 28 and other parts within the inner conduit. Since ambient air is also flowing through outer air conduit 30 the temperature of the entire display case is increased during the defrost cycle of operation, thereby speeding up the defrost operation.

Figure 8:
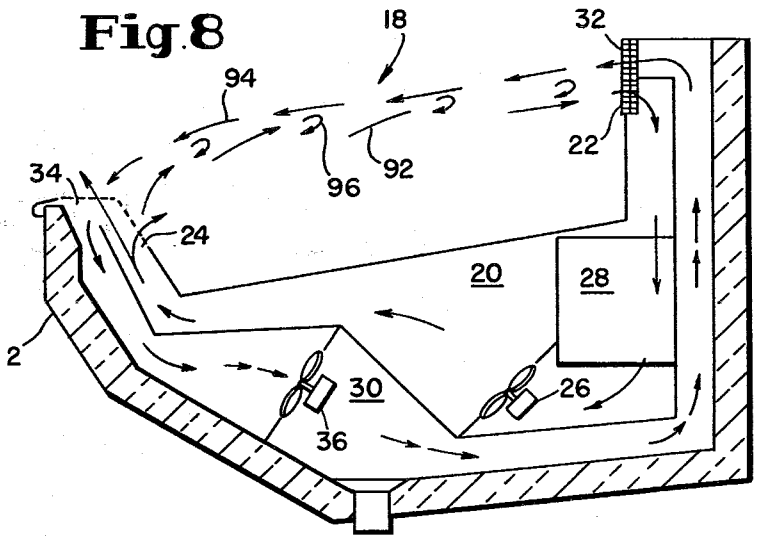
FIG. 8 is a side elevational, sectional view of a top display case in accordance with another embodiment of the present invention during a defrost cycle of operation.

A further possible type of embodiment for the display cases involves reversing the direction of air flow through the inner air conduit while maintaining the direction of flow of air through the outer air conduit. In this manner, the air band and likewise the air curtains are flowing in opposite directions thereby causing a mixture of the air of the two air bands. Thus, as shown in FIG. 8, the air through inner air conduit 20 is reversed. While a portion of the air will leave the conduit through inlet opening 24 in a direction up and away from the display case due to the existence of the outer air band and outer air curtain, such as shown by arrow 94 a portion of the inner air band will be directed across the opening 18 in the top of the display case such as represented by arrow 92. As the air of the inner air band moves across the opening in the top of the display case, air from the outer air curtain 94 will be mixed with the inner air curtain, such as represented by arrows 96. This mixture of the two air bands serves to increase the temperature of the inner air band which in turn helps to defrost the evaporator coils and other parts within the inner air conduit.

During the defrost cycle of operation of any of the embodiments of the present invention, the flow of ambient air through the inner air conduit can be increased as compared to the forward air flow during refrigeration in order to rapidly carry out the defrost operation. Such an increase in air flow can be created by increasing the speed of the fans during the reverse flow or by constructing the fans such that during a reverse operation they propel a greater quantity of air than in the forward direction. The increase in the air flow can be on the order of between 25 and 50%.

The present invention may be embodied in other specific forms without departing from the spirit or essential characteristics thereof. The present embodiments are presented merely as illustrative and not restrictive with the scope of the invention being indicated by the attached claims rather than the foregoing description. All changes which come within the meaning and range of equivalency of the claims are therefore intended to be embraced therein.

What is claimed is:

1. An open top refrigerated display case comprising: a cabinet having top, bottom and opposing side walls and an opening within said top wall for enabling access to products displayed within said display case;

an inner air conduit passing around said side and bottom walls of said cabinet and having a first air outlet opening adjacent one end of said opening in said top wall of said cabinet and a first air inlet opening adjacent the other end of said opening in said top wall of said cabinet with said first air outlet and said first air inlet being aligned so that air leaving said first outlet is directed towards and received by said first air inlet;

first air circulating means arranged for circulating air through said inner air conduit so as to establish an inner air band and an inner air curtain across said opening in said top wall of said cabinet;

refrigeration means for cooling air passing through said inner air conduit during a refrigeration cycle of operation of said display case and being capable of being turned off during a defrost cycle of operation;

an outer air conduit passing along said bottom and side walls of said cabinet and being arranged adjacent to said inner air conduit but outwardly therefrom and having a second air outlet opening adjacent one end of said opening in said top wall of said cabinet and a second air inlet located adjacent the other end of said opening in said top wall of said cabinet with said second air outlet and said second air inlet being aligned so that air leaving said second air outlet is directed towards and received by said second air inlet;

second air circulating means for circulating air through said outer air conduit so as to establish an outer air band with an outer air curtain across said opening in said top wall of said cabinet;

said inner and outer air conduits have at least a partial common wall, said common wall having at least one opening therein for enabling air to pass from one of said conduits to the other of said conduits;

control means for causing ambient air to pass through said inner air conduit during a defrost cycle and turning off said refrigeration means so that air passing through said inner and outer air conduits is unrefrigerated during such defrost cycle and said control means including means for reversing the direction of air flow through at least one of said inner and outer air conduits during a defrost cycle; and means for causing ambient air to pass through said opening in said common wall so that at least a portion of such ambient air flows from said outer air conduit into said inner air conduit during a defrost cycle of operation.

2. A display case according to claim 1 wherein said inner and outer air conduits have at least a partial common wall and said means for causing the passage of air between said conduits includes a plurality of perforations in said common wall.

3. A display case according to claim 2 wherein said means for causing the passage of air between said conduits further includes a plurality of guide fins for directing air between said conduit, each of said guide fins being associated with one of said perforations in said common wall.

4. A display case according to claim 1 wherein said inner and outer air conduits have a partial common wall with an opening therein and an air scoop within said opening for directing air passing along one of said conduits into the other of said conduits.

5. A display case according to claim 1 wherein said control means causes the flow of air through said outer air conduit to be reversed during a defrost cycle of operation.

6. A display case according to claim 5 wherein during a defrost cycle operation said second circulating means draws ambient air from outside of said display case into said outer air conduit and circulates such ambient air through said outer air conduit and into said inner air conduit.

7. A display case according to claim 6 wherein said inner and outer air conduits have at least a partial common wall and said means for causing air to flow from said outer air conduit into said inner air conduit includes a plurality of perforations in said common wall.

8. A display case according to claim 7 wherein said means for causing the passage of air from said outer air conduit into said inner air conduit further includes a plurality of guide fins, each of said guide fins being associated with a corresponding perforation in said common wall for directing air through the respective one of said perforation.

9. A display case according to claim 6 wherein said inner and outer air conduits have at least a partial common wall with an opening being provided in said common wall and said means for causing passage of air from said outer air conduit into said inner air conduit includes at least one air scoop arranged within said opening in said common wall for directing air flowing in a reverse direction through said outer air conduit into said inner air conduit.

10. A display case according to claim 5, 8 or 9 wherein said second air circulating means includes at least one reversible fan capable of circulating air in either direction through said outer air conduit and said control means causes said reversible fan of said second air circulating means to circulate air in a reverse direction through said outer air conduit during a defrost cycle.

11. A display case according to claim 5, 6, 7, 8 or 9 wherein during a defrost cycle a portion of the air flowing in a reverse direction is expelled from said second air conduit through said second air inlet and said second air inlet is formed so as to direct such air being expelled therefrom up and away from said display case.

12. An open top refrigerated display case comprising:

a cabinet having top, bottom and opposing side walls and an opening within said top wall for enabling access to products displayed within said display case;

an inner air conduit passing around said side and bottom walls of said cabinet and having a first air outlet opening adjacent one end of said opening in said top wall of said cabinet and a first air inlet opening adjacent the other end of said opening in said top wall of said cabinet with said first air outlet and said first air inlet being aligned so that air leaving said first outlet is directed towards and received by said first air inlet;

first air circulating means arranged for circulating air through said inner air conduit so as to establish an inner air band and an inner air curtain across said opening in said top wall of said cabinet;

refrigeration means for cooling air passing through said inner air conduit during a refrigeration cycle of operation of said display case and being capable of being turned off during a defrost cycle of operation;

an outer air conduit passing along said bottom and side walls of said cabinet and being arranged adjacent to said inner air conduit but outwardly therefrom and having a second air outlet opening adjacent one end of said opening in said top wall of said cabinet and a second air inlet located adjacent the other end of said opening in said top wall of said cabinet with said second air outlet and said second air inlet being aligned so that air leaving said second air outlet is directed towards and received by said second air inlet;

second air circulating means for circulating air through said outer air conduit so as to establish an outer air band with an outer air curtain across said opening in said top wall of said cabinet; and, control means for causing ambient air to flow through both said inner air conduit and said outer air conduit in a reverse direction during a defrost cycle and turning off said refrigeration means during such defrost cycle.

13. A display case according to claim 12 wherein said first air circulating means includes at least one reversible fan capable of being driven for circulating air in either direction through said inner air conduit and said control means causes said fan to be operated during a defrost cycle for circulating air in a reverse direction through said inner air conduit.

14. A display case according to claim 12 wherein said second air circulating means includes at least one reversible fan capable of circulating air in either direction through said outer air conduit and said control means causes said reversible fan of said second air circulating means to circulate air in a reverse direction through said outer air conduit during a defrost cycle.

15. A display case according to claim 12 wherein during a defrost cycle of operation air is expelled from said inner and outer air conduit through said first and second air inlet and said first and second air inlets are formed so as to direct air up and away from said display case and said first and second air circulating means draws ambient air into said inner and outer air conduits during a defrost cycle.

16. A display case according to claim 15 wherein said second air circulating means includes at least one reversible fan capable of circulating air in either direction through said outer air conduit and said control means causes said reversible fan of said second air circulating means to circulate air in a reverse direction through said outer air conduit during a defrost cycle.

17. A method of operating an open top refrigerated display case wherein the display case includes:

a cabinet having top, bottom and opposing side walls and an opening within the top wall for enabling access to products displayed within the display case; an inner air conduit passing around the side and bottom walls of the cabinet and having a first air outlet opening adjacent one end of the opening in the top wall of said cabinet and a first air inlet opening adjacent the other end of said opening in said top wall of the cabinet with the first air outlet and the first air inlet being aligned so that air leaving the first outlet is directed towards and received by the first air inlet; and an outer air conduit passing along the bottom and side walls of the cabinet and being arranged adjacent to the inner air conduit but outwardly therefrom and having a second air outlet opening adjacent one end of the opening in the top wall of the cabinet and a second air inlet located adjacent the other end of the opening in the top wall of the cabinet with the second air outlet and the second air inlet being aligned so that air leaving said second air outlet is directed towards and received by the second air inlet and, the inner and outer air conduits having at least a partial common wall, the common wall having at least one opening therein for enabling air to pass from one of the conduits into the other of the conduits; said method comprising the steps of:

circulating air through the inner air conduit so as to establish an inner air band and an inner air curtain across the opening in the top wall of the cabinet;

cooling air passing through the inner air conduit only during a refrigeration cycle of operation of the display case;

circulating air through the outer air conduit so as to establish an outer air band with an outer air curtain across the opening in the top wall of the cabinet;

causing ambient air to pass through the inner air conduit during a defrost cycle and ceasing the cooling of the air during such defrost cycle;

reversing the direction of air flow through at least one of the inner and outer air conduits during a defrost cycle; and drawing ambient air from outside of the display case into the outer air conduit and causing a portion of such ambient air as it flows through the outer air conduit to be diverted through the opening in the common wall into the inner air conduit so that such ambient air passes through the inner air conduit for defrosting such conduit.

18. A method of operating an open top refrigerated display case where the display case includes:

a cabinet having top, bottom and opposing side walls and an opening within the top wall for enabling access to products displayed within the display case; an inner air conduit passing around the side and bottom walls of the cabinet and having a first air outlet opening adjacent one end of the opening in the top wall of said cabinet and a first air inlet opening adjacent the other end of said opening in said top wall of the cabinet with the first air outlet and the first air inlet being aligned so that air leaving the first outlet is directed towards and received by the first air inlet; and, an outer air conduit passing along the bottom and side walls of the cabinet and being arranged adjacent to the inner air conduit but outwardly therefrom and having a second air outlet opening adjacent one end of the opening in the top wall of the cabinet and a second air inlet located adjacent the other end of the opening in the top wall of the cabinet with the second air outlet and the second air inlet being aligned so that air leaving said second air outlet is directed towards and received by the second air inlet; said method comprising the steps of:

circulating air through the inner air conduit so as to establish an inner air band and an inner air curtain across the opening in the top wall of the cabinet;

cooling air passing through the inner air conduit only during a refrigeration cycle of operation of the display case;

circulating air through the outer air conduit so as to establish an outer air band with an outer air curtain across the opening in the top wall of the cabinet;

causing ambient air to pass through the inner air conduit during a defrost cycle and ceasing the cooling of the air during such defrost cycle;

reversing the direction of air flow through the inner and outer air conduits during a defrost cycle of operation so that ambient air from outside of the display case is drawn into both conduits during a defrost cycle of operation.

19. A method according to claim 17 or 18 wherein the air flow through the inner air conduit is increased during the defrost cycle of operation as compared to the air flow during a refrigeration cycle of operation.

20. A method according to claim 19 wherein the air flow through the inner air conduit is increased by 25 to 50%.

21. An open top refrigerated display case comprising:

a cabinet having top, bottom and opposing side walls and an opening within said top wall for enabling access to products displayed within said display case;

an inner air conduit passing around said side and bottom walls of said cabinet and having a first air outlet opening adjacent one end of said opening in said top wall of said cabinet and a first inlet opening adjacent the other end of said opening in said top wall of said cabinet with said first air outlet and said first air inlet being aligned so that air leaving said first outlet is directed towards and received by said first air inlet;

first air circulating means arranged for circulating air through said inner air conduit so as to establish an inner air band and an inner air curtain across said opening in said top wall of said cabinet;

refrigeration means for cooling air passing through said inner air conduit during a refrigeration cycle of operation of said display case and being capable of being turned off during a defrost cycle of operation;

an outer air conduit passing along said bottom and side walls of said cabinet and being arranged adjacent to said inner air conduit but outwardly therefrom and having a second air outlet opening adjacent one end of said opening in said top wall of said cabinet and a second air inlet located adjacent the other end of said opening in said top wall of said cabinet with said second air outlet and said second air inlet being aligned so that air leaving said second air outlet is directed towards and received by said second air inlet;

second air circulating means for circulating air through said outer air conduit so as to establish an outer air band with an outer air curtain across said opening in said top wall of said cabinet; and, control means for causing ambient air to flow through said inner air conduit in a reverse direction during a defrost cycle and turning off said refrigeration means during such defrost cycle so that the reverse flow of air through said inner air conduit during a defrost cycle of operation forms a reverse direction inner air curtain across said opening in said top wall of said cabinet and the direction of air flow through said outer air conduit is maintained during a defrost cycle of operation so that air from the outer air curtain mixes with the air of the reverse direction air curtain during a defrost cycle so as to increase the temperature of the reverse flow inner air band.

* * * * *